US007798117B2

(12) United States Patent
Gerstberger et al.

(10) Patent No.: US 7,798,117 B2
(45) Date of Patent: Sep. 21, 2010

(54) METHOD FOR DRAINING A FUEL STORAGE OF A FUEL-INJECTED SYSTEM AND CORRESPONDING DEVICE

(75) Inventors: Uwe Gerstberger, Ingolstadt (DE); Michael Zimmermann, Ingolstadt (DE)

(73) Assignee: Audi AG, Ingolstadt (DE)

( * ) Notice: Subject to any disclaimer, the term of this patent is extended or adjusted under 35 U.S.C. 154(b) by 176 days.

(21) Appl. No.: 12/010,816

(22) Filed: Jan. 30, 2008

(65) Prior Publication Data

US 2008/0210776 A1 Sep. 4, 2008

(30) Foreign Application Priority Data

Jan. 31, 2007 (DE) ..... 10 2007 004 775

(51) Int. Cl.
*F02B 67/00* (2006.01)
*B65B 31/04* (2006.01)

(52) U.S. Cl. ..... 123/198 C; 141/65

(58) Field of Classification Search ..... 123/514; 141/65; 239/126
See application file for complete search history.

(56) References Cited

U.S. PATENT DOCUMENTS 2,341,758 A * 2/1944 Carpenter ..... 137/107
D248,236 S * 6/1978 Senese ..... D15/150
4,520,773 A * 6/1985 Koslow ..... 123/198 A
5,115,786 A * 5/1992 Yamada ..... 123/531
6,474,443 B2 * 11/2002 Kearns et al. ..... 184/1.5
6,860,300 B1 * 3/2005 Kuntz ..... 141/65
7,331,330 B2 * 2/2008 Houy et al. ..... 123/470

FOREIGN PATENT DOCUMENTS

DE 103 53 141 6/2005
DE 10 2004 039 260 3/2006

* cited by examiner

*Primary Examiner*—Stephen K Cronin
*Assistant Examiner*—David Hamaoui
(74) *Attorney, Agent, or Firm*—Novak Druce + Quigg LLP

(57) ABSTRACT

The invention relates to a method for draining a fuel storage of an injection system of an internal combustion engine for an automobile, particularly a motor vehicle, having at least one injection valve. It is provided that the draining is carried out by means of suctioning off the fuel, wherein the injection valve is placed into the open position, or is placed into the open position at least once for venting the injection system during the suctioning off process. The invention further relates to a corresponding device.

7 Claims, 1 Drawing Sheet

METHOD FOR DRAINING A FUEL STORAGE OF A FUEL-INJECTED SYSTEM AND CORRESPONDING DEVICE

CROSS-REFERENCE TO RELATED APPLICATIONS

This application claims priority from German Application No. 10 2007 004 775.6 filed Jan. 31, 2007, hereby incorporated by reference in its entirety.

The invention relates to a method for draining a fuel storage of an injection system of an internal combustion engine for an automobile, particularly a motor vehicle, having at least one injection valve.

BACKGROUND OF THE INVENTION

Whenever work, such as rebuilding, repairs, and disassemblies of the internal combustion machine having a fuel injection system must be performed at a repair shop, the internal combustion engine, including the fuel injection system, must be separated from a fuel tank, and from a fuel supply system having at least one fuel line, before this type of work commences. In order to avoid the release of any fuel vapors and fuel, which may pose a health risk, the fuel storage of the fuel injection system must also be depressurized and drained when a tank injection (common rail) is present. In order to relieve pressure in the fuel storage, it is common, for example, to loosen the threaded connector attached thereto. This reduces the pressure inside of the fuel storage to atmospheric pressure, which, during the operation of the internal combustion engine—and even for a longer period of time afterward—is more than 100 bars. However, loosening the threaded connector has the disadvantage that usually fuel discharges uncontrollably into the environment, and may pose a health risk.

In addition to this method of relieving pressure and draining the fuel storage, other methods are also known, wherein the fuel from the fuel storage of the fuel injection system is drained into the fuel tank before disassembling the fuel line. DE 103 53 141 A1 discloses a method, wherein a piston in an unlit cylinder of the internal combustion engine is positioned so that compression pressure is built in the cylinder, which drains the fuel from the fuel storage of the fuel injection system into the fuel tank.

In many cases the internal combustion engine has already been separated from the fuel supply system due to previous working steps performed on the internal combustion engine. It is therefore the task of the invention of providing a method and a corresponding device, which ensures a safe and complete draining of the fuel storage, even in this situation.

SUMMARY OF THE INVENTION

In order to solve this task it is provided that the draining is carried out by means of suctioning off the fuel, wherein during the suctioning off process the injection valve is placed into the open position, or is placed into the open position at least once for venting the fuel injection system. After separating the internal combustion engine having the injection system from the fuel supply system (low-pressure system), particularly the following process steps are performed: connecting a fuel suction line that is connected to a suction pump, and particularly is connected to a fuel reception tank, to the injection system; connecting an electric connecting line connected to an electric circuit for generating electric impulses for an input signal to be performed for opening the injection valve, for the impulse transmission to the internal combustion engine; suctioning off the fuel from the injection system, wherein the injection valve is placed into the open position, or is placed into the open position at least once for venting the injection system before the suctioning off process. This causes the injection valves to be opened in turn, for example, in the manner of intervals.

Further, it is advantageously provided that the internal combustion engine has at least one outlet valve, and/or at least one inlet valve, which is open, or is placed into the open position, or is placed into the open position at least once during the suctioning off process. In internal combustion engines having a multitude of cylinders, as is common in automobiles; particularly motor vehicles, at least one of the inlet valves or of the outlet valves of the cylinder of the internal combustion engine is open at any given time. In an internal combustion engine, in which this is not the case, such as, for example, in an internal combustion engine having only one cylinder, at least one inlet or outlet valve must be placed into the open position. This can be achieved, for example, by means of rotating the crank shaft.

The invention further relates to a device for draining a fuel storage of an injection system with an internal combustion engine for an automobile, particularly a motor vehicle, having at least one injection valve. It is provided that the device has a fuel suction line that can be connected to the injection system, a suction pump, and an electric circuit for generating electric impulses for an input signal to be performed for opening the injection valve, as well as an electric connecting line for the electric connection to the internal combustion engine to be carried out for the impulse transmission. Such a device provides the advantage that the draining of the fuel storage of the injection system is possible safely and completely, even if the internal combustion engine having the injection system has already been separated from a fuel supply system having a fuel tank, preferably a fuel supply system of a motor vehicle. In order to drain the fuel storage, particularly after the internal combustion engine has already been separated from the fuel supply system, the following steps are provided: connecting a fuel suction line that is connected to a suction pump to the injection system; connecting an electric connecting line connected to an electric circuit for generating electric impulses for transmitting these impulses to the internal combustion engine; suctioning off the fuel from the injection system, wherein the injection valve is placed into the open position, or is placed into the open position at least once for venting the injection system before the suctioning off process.

It is particularly provided that the device is embodied as a portable unit. For this purpose, this portable unit particularly has dimensions such that it may be effortlessly carried by a single person. Furthermore, the device embodied as a portable unit can be operated in a self-sufficient manner, for which purpose it has its own electrical storage, such as a rechargeable battery. For the embodiment as a portable unit, the device is arranged in a case, or a trolley. A trolley is to be understood as a case-like housing with wheels (rolling suitcase), particularly with a handle for pulling the trolley while walking.

According to a further development of the invention it is provided that the device has a fuel reception tank. The fuel reception tank is connected to the fuel suction line, and has an outlet valve for draining.

It is advantageously provided that the fuel reception tank has a volume that is larger than the fuel amount in the injection system. Depending on the type of internal combustion engine, the injection system has about 50 to 200 ccm of fuel.

The fuel reception tank of the device is therefore dimensioned such that it may accommodate at least one fuel load of an injection system.

Finally, it is advantageously provided that the fuel reception tank has a volume that is smaller than the volume of a fuel tank of the motor vehicle. By means of this limitation of the volume of the fuel reception tank, an adequately good manageability of the entire device for draining the fuel storage is achieved. If the device is embodied as a portable unit, an acceptable weight that can be carried is provided, even if the fuel reception tank is full. The fuel reception tank particularly has a volume (reception volume) of 1 to 2 liters.

DETAILED DESCRIPTION OF PREFERRED EMBODIMENTS OF THE INVENTION

Figure 1:
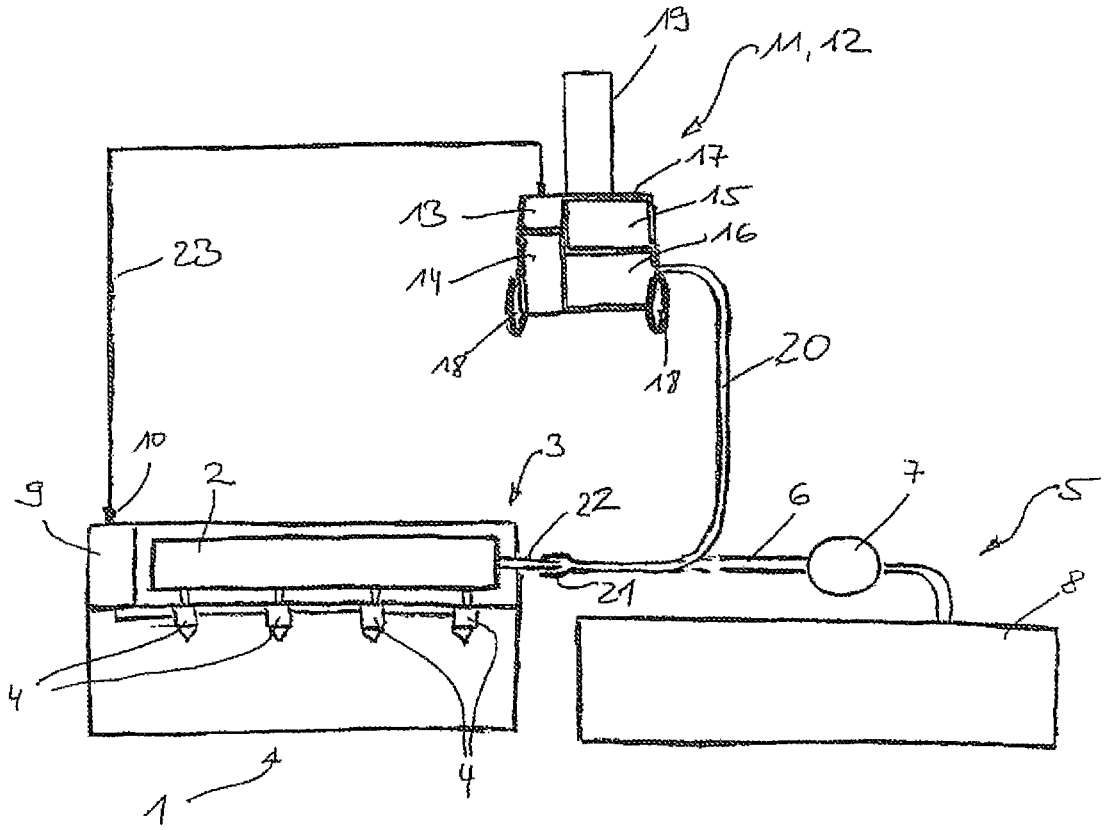
FIG. 1 is a diagrammatic view of a device for draining a fuel storage of an injection system of an internal combustion engine for a motor vehicle.

The figure illustrates an internal combustion engine 1 for a not illustrated motor vehicle with an injection system 3 having a fuel storage (common rail) 2, to which a number of injection valves 4 corresponding to the number of cylinders is assigned. For the fuel supply of the internal combustion engine 1 the same is connected to a fuel supply system 5. The fuel supply system 5 has a fuel line 6, a fuel pump 7, and a fuel tank 8, wherein the fuel supply system 5 is connected to the internal combustion engine 1, or its injection system 3, respectively, by means of the fuel line 6 (dotted lines). The internal combustion engine 1 has a control device 9 which, among other things, triggers the injection valves 4, and an electric connection 10, via which control impulses can be imputed to the individual injection valves 4. In order to drain the fuel storage 2 of the injection system 3, a device 11 is provided in the embodiment example illustrated in the figure, which is embodied as a portable unit 12. The portable unit 12 has an electric circuit 13 for generating electric impulses for opening the injection valves 4, an electrically driven suction pump 14, a rechargeable battery 15 for the self-sufficient power supply of the device 11, and a fuel reception tank 16. Furthermore, the portable unit 12 has a housing 17 in the manner of a trolley for the enclosure of the electric circuit 13, the suction pump 14, the battery 15, and the fuel reception tank 16. On its edge end region, the housing 17 has two wheels 18, and a handle 19 in its top region. In order to connect the device 11 embodied as a portable unit 12 to the internal combustion engine 1, the device 11 has a fuel suction line 20 with a connection 21 that can be connected to a connection 22 of the injection system 3 of the internal combustion engine 1. For the electric contacting of the electric circuit 13 with the internal combustion engine 1 (for example, via electrical connection contacts 10 of the injection system 3 arranged on the control device 9), the device 11 has at least one electric connecting line 23.

This results in the following function of the device 11, or the following method for draining the fuel storage 2 of the injection system 3, respectively: in order to carry out any rebuilding, repairs, or disassemblies of components of the internal combustion engine 1, the same is usually separated from the associated fuel supply system 5 in the area of a fuel line 6. If work has to be performed on the injection system 3, or any work for which the injection system 3 must be disassembled, the fuel remaining in the injection system 3, particularly in the fuel storage 2 of the injection system 3, is removed by means of the device 11. For this purpose, the fuel suction line 20 of the device 11 is connected to the injection system 2. Various adapters are provided for various types of internal combustion engines. Subsequently, the internal combustion engine 1 is connected, particularly at the connection contacts 10 of the control device 9, or the separate connection contacts 10 for triggering the injection valves 4, to the electric connecting line 23 of the device 11. After startup of the device 11, in which the suction pump 14 starts, at least one of the injection valves 4 is placed into the open position, or is placed into the open position at least once while the suction pump 14 suctions off the fuel from the fuel storage 2 by an electric impulse generated by the electric circuit 13, and transmitted via the electric connecting line 23. Therefore, either at least one of the injection valves 4 is permanently open, or at least one of the injection valves 4 is opened in the manner of intervals, or the injection valves 4 are opened in turn in the manner of intervals during the suctioning time. After completion of the suctioning off process, particularly if no further fuel can be suctioned off by means of the respective method, the device 11 is turned off, and the connections (connecting line 23 and fuel suction line 20) are removed from the connection contact 10, or from the connection 22 of the internal combustion engine 1, respectively. The sequence of these process steps, however, is not mandatory. In particular the sequence of the connecting/removing of the fuel suction line 20 and of the connection line 23 is not specified.

The following advantages are achieved: by means of the method according to the invention, and the device 11 according to the invention, the fuel storage 2 of the injection system 3 of an internal combustion engine 1 can be completely drained in a safe manner without any risk. The content of the fuel storage 1 is particularly placed into the fuel reception tank 16, which enables the handling of the fuel without any risk. If the device 11 is particularly embodied as a portable unit 12, maneuverability is facilitated and such a device 11 is rendered particularly flexible. Another advantage of the method according to the invention, and the device 11 according to the invention is the possibility of also suctioning off fuel vapors in addition to liquid fuel, which are subsequently confined in the fuel reception tank 16. The device 11 according to the invention, particularly the device 11 having a fuel reception tank 16, reduces any health risks due to escaping fuel vapors and fuel. Furthermore, the risk of explosion and/or fie are significantly reduced.

LIST OF REFERENCE SYMBOLS

1 internal combustion engine
2 fuel storage
3 injection system
4 injection valve
5 fuel supply system
6 fuel line
7 fuel pump
8 fuel tank
9 control device
10 connection contact
11 device
12 unit
13 circuit
14 suction pump
15 battery
16 fuel reception tank
17 housing
18 wheel
19 handle

20 fuel suction line
21 connection adapter
22 connection
23 connecting line

The invention claimed is:

1. A unit for draining fuel stored in an injection system of an internal combustion engine on board a motor vehicle, provided with at least one fuel injection valve, comprising:

a support device independent of said motor vehicle;

means disposed on said support device for storing fuel and fuel vapors;

means disposed on said support device connected to a said fuel storing means and connectable to said injection valve for applying a negative pressure to said injection valve; and means disposed on said support device and operatively connectable to said injection system for operating said fuel injection valve.

2. A unit according to claim 1 including means connected to said fuel storing means, connectable to said injection system.

3. A unit according to claim 1 wherein the storage capacity of said fuel storing means is greater than the fuel storage capacity of said injection system.

4. A unit according to claim 1 wherein the storage capacity of said fuel storing means is less than the fuel storage means of said vehicle.

5. A unit according to claim 1 wherein said support device is portable.

6. A unit according to claim 1 wherein said support device is mounted on a set of wheels.

7. A unit according to claim 1 wherein said means for operating said fuel injection valve comprises an electrical system operative to emit electric impulses.

* * * * *